US005782674A

United States Patent [19]

Hahn

[11] Patent Number: 5,782,674

[45] Date of Patent: Jul. 21, 1998

[54] SENSORS FOR INTERNAL GRINDING MACHINES

[76] Inventor: Robert S. Hahn, 218 E. Hill Rd., Oakham, Mass. 01068

[21] Appl. No.: 859,153

[22] Filed: May 20, 1997

Related U.S. Application Data

[60] Provisional application No. 60/018,447 May 25, 1996.

[51] Int. Cl.[6] ..... B24B 49/00

[52] U.S. Cl. ..... 451/9; 451/49; 451/51; 451/143; 451/242; 451/246

[58] Field of Search ..... 451/9, 27, 49, 451/51, 61, 180, 182, 212, 199, 242, 246, 143

[56] References Cited

U.S. PATENT DOCUMENTS

| | | | |
|---|---|---|---|
| 2,680,941 | 6/1954 | Hahn | 451/143 |
| 4,505,074 | 3/1985 | Kogure | 451/143 |
| 4,606,150 | 8/1986 | Grimm | 451/143 |
| 5,044,125 | 9/1991 | Lambert, Jr. et al. | 451/51 |

*Primary Examiner*—Robert A. Rose
*Assistant Examiner*—George Nguyen
*Attorney, Agent, or Firm*—Blodgett & Blodgett, P.C.

[57] ABSTRACT

A grinding machine for grinding an internal cylindrical surface of a workpiece in which the workpiece is moved toward a grinding wheel along the axis of revolution of the workpiece and the grinding wheel is moved transversely of the axis of revolution toward the cylindrical surface of the workpiece. The grinding wheel is mounted on a supporting structure which is mounted for pivoting about an axis which is transverse to the axis of revolution. A deflective stiffening element restrains the angular displacement of the supporting structure. The deflection of the stiffening element is proportional to the deflection of the spindle. The deflection of the stiffening element is measured by a sensor which transmits an electrical signal to a drive mechanism for angularly positioning the supporting structure in response to the signal to compensate for the deflection of the spindle. A ring-shaped workpiece is supported on the workhead by a magnetic face plate. The outer surface of the ring is engaged by a pair of shoes to establish a workpiece axis of revolution which is offset from the axis of revolution of the wheelhead. A sensor is mounted on the grinding machine for detecting the position of the outer surface of the ring and for transmitting an electrical signal to a computer for calculating the relative OD size of the ring in comparison to a norm for rings and for controlling the transverse feed of the grinding wheel in accordance with sensed OD size of the ring.

9 Claims, 8 Drawing Sheets

SENSORS FOR INTERNAL GRINDING MACHINES

CROSS-REFERENCE TO RELATED APPLICATIONS

This application claims the benefit of Provisional Application No. 60/018,447 filed May 28, 1996.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

Internal grinding machines are used extensively in the production of ball and roller bearings, automotive valve lifters, fuel injection nozzle bodies, power steering elements, gears, pumps, transmission parts, jet engine components and other precision parts required in the production of high performance engines and machinery. The materials used in those parts range from easy-to-machine cast iron, to difficult-to-machine alloy steels and very hard ceramic compositions. Lot sizes for JIT (just-in-time) production, run from a few components to very large quantities for some parts such as automotive valve lifters. Where small lots are produced, change-over time from one part number to another contributes more to the cost of production than the actual grinding-cycle time. On large production runs, the grind-cycle time controls the production cost. In one instance a reduction of grind-cycle time by one second resulted in a savings of over $1,000,000 per year.

In general, internal grinding machines consist of a base, a workhead mounted on the base for supporting the workpiece and rotating the workpiece about the axis of the surface of revolution to be ground, a wheelhead having a rotatable spindle which is adapted to carry an abrasive wheel, and a feed means for moving the wheelhead toward the workpiece, causing the wheel to engage the bore of the workpiece and remove unwanted stock to generate a cylindrical surface of revolution with a high degree of form and dimensional accuracy.

One type of internal grinding machine, known as a chucking grinder, holds the workpiece in a chuck mounted on the workhead. That type of grinder is used for grinding the bore of thick-walled parts where the chucking forces do not cause appreciable deformation of the workpiece. Ball and roller bearing rings, on the other hand, have a relatively thin wall and would be deformed by the chucking forces, resulting in unacceptable geometric errors. Therefore, those rings are ground on shoe-type internal grinders, where the ring is rotated by a magnetic driver plate, and held against a pair of stationary shoes arranged at "3 o'clock" and "6 o'clock" positions. The outside diameter is located by these shoes. The accuracy of the internal grind operation generating the bore, is directly related to the accuracy of the outside diameter; for example, a 10 micrometer error on the OD will cause a 10 micrometer error on the ID, an undesirable feature of the prior art machines. Accordingly, OD size variations cause ID size errors. The present invention provides a novel method for eliminating ID size errors due to variations in the OD size.

In the operation of many automatic production-type internal grinding machines, a small diameter grinding wheel is mounted on a rotatable spindle for rotation at high speed.

The wheel and extended portion of the spindle must be of a suitable diameter to enter the unfinished bore of the workpiece, which may typically be 15 millimeters. Because of the small diameter spindle, the system stiffness (resistance to deflection) at the wheel is necessarily low. As workpieces are ground by feeding the wheel radially toward the unfinished bore, grinding forces develop between wheel and workpiece. The normal component of the grinding force deflects the wheel in a manner similar to a cantilever beam with a load at the free end. That causes both a lateral and an angular deflection of the wheel.

The feed means, used to position the wheelhead, are very precise in current machines and provide sub-micrometer positioning accuracy. However, that degree of accuracy is not transferred to the bore of the workpiece because of deflections of the wheel and wheelhead spindle and because of OD size variations. Variations in the lateral deflection cause errors in the bore size. The angular deflection of the cantilevered wheel causes taper errors in the bore.

My issued U.S. Pat. No. 4,590,573, compensates for the lateral deflection errors by incorporating normal force sensors in the wheelhead, capturing the signal therefrom, and sending it to a computer control, where the normal force is divided by the system stiffness to obtain the lateral deflection. The control then modifies the feed position appropriately to eliminate the deflection-caused errors. That procedure is referred to as "DEFLECTION-COMPENSATED SIZING". Said patent also provides a means for angularly displacing the wheelhead axis by a small angle to eliminate the taper caused by the angular deflection of the wheel.

This invention provides an improved normal force sensor system for acquiring the normal force between wheel and workpiece. The normal force sensor or load cell indicated in FIG. 2 of U.S. Pat. No. 4,590,573 is located in the front end of the wheelhead. That makes the wheelhead unique, and requires specially modified wheelheads. It is preferred to use standard commercially available wheelheads and to devise some other means for measuring the normal force while permitting angular displacement of the wheelhead.

A principal object of this invention is to provide a precise sensor system for use with commercially-available wheelheads, to eliminate deflection errors due to normal force variations, thereby improving the accuracy of internal grinding operations.

Another object of this invention is to provide a structure for supporting commercially-available wheelheads, and providing simultaneously, means for sensing the normal force, and means for inclining the wheelhead axis at small angles relative to the surface of revolution, to eliminate taper errors.

A further object of the invention is to provide a frictionless supporting structure for commercially-available wheelheads, to enable accurate force measurements.

A still further object of the invention is the provision of vibration-dampening means to prevent oscillation of the frictionless supporting structure for the wheelhead.

An additional object of the invention is to provide a means for compensating for OD size variations to increase the accuracy of internal grind operations on shoe-type internal grinders.

With these and other objects in view, as will be apparent to those skilled in the art, the invention resides in the combination of parts set forth in the specifications and covered by the claims appended thereto.

SUMMARY OF THE INVENTION

A grinding machine for grinding an internal surface of revolution about an axis of revolution on a workpiece. The grinding machine includes a workhead for supporting and rotating the workpiece and a wheelhead for supporting an abrasive wheel on the end of a spindle and for rotating the spindle. The workhead is moved toward the wheelhead by a longitudinal feed mechanism. The wheelhead is moved transversely of the axis of revolution toward the internal surface of revolution. The wheelhead is supported by a wheelhead supporting structure that is mounted for pivoting about a vertical pivoting axis adjacent the front end of the wheelhead. A normal grinding force causes the spindle to deflect from the axis of revolution and causes the wheelhead supporting structure to pivot about the pivoting axis. A deflectable stiffening element is connected to the wheelhead supporting structure for restraining angular displacement of the supporting structure. The deflection of the stiffening element is proportional to the deflection of the spindle. The deflection of the stiffening element is measured by sensing means which transmits an electrical signal to drive means for angularly positioning the wheelhead supporting structure about the pivoting axis in response to the signal to compensate for the deflection of the spindle.

The grinding machine of the present invention also includes means for grinding the inner cylindrical surface of a ring-shaped workpiece which also has an outer cylindrical surface. The grinding machine includes a workhead having a magnetic face plate for magnetically attracting the workpiece. The workhead has a workhead axis of revolution. A pair of angularly spaced shoes are arranged in a plane parallel to and axially offset from the magnetic face plate for engaging the outer cylindrical surface of the workpiece to establish a workpiece axis of revolution which is offset from the workhead axis of revolution. This produces a magnetically derived thrust force for driving the workpiece into the shoes, in addition to rotating the workpiece about the workpiece axis of revolution. The workhead is moved along the workhead axis of revolution toward and away from the wheelhead to bring the abrasive wheel into abutment with the inner surface of the workpiece. The wheelhead is moved transversely of the wheelhead axis of revolution to bring the grinding wheel into grinding engagement with the inner cylindrical surface of the workpiece. A sensor is mounted on the grinding machine for detecting the position of the outer cylindrical surface of the workpiece. The outer surface is detected at a point tangent to the workpiece-ejection trajectory, of an arbitrary workpiece relative to the outer cylindrical position of a workpiece representing the norm of a series of workpieces. The sensing means transmits an electrical signal which is indicative of the size difference of the outer cylindrical surface of the workpiece to a digital computer for calculating the relative size difference of the arbitrary workpiece based on the digital electrical signal from the sensing means. The computer controls the transverse feed means to position the grinding wheel relative to the fixed angularly spaced shoes to eliminate errors in size of the inner cylindrical surface of the workpiece resulting from variations in size of the outer cylindrical surface of the workpiece.

BRIEF DESCRIPTION OF THE DRAWINGS

The character of the invention, however, may be best understood by reference to one of its structural forms, as illustrated by the accompanying drawings in which.

DESCRIPTION OF THE PREFERRED EMBODIMENT

Figure 1:
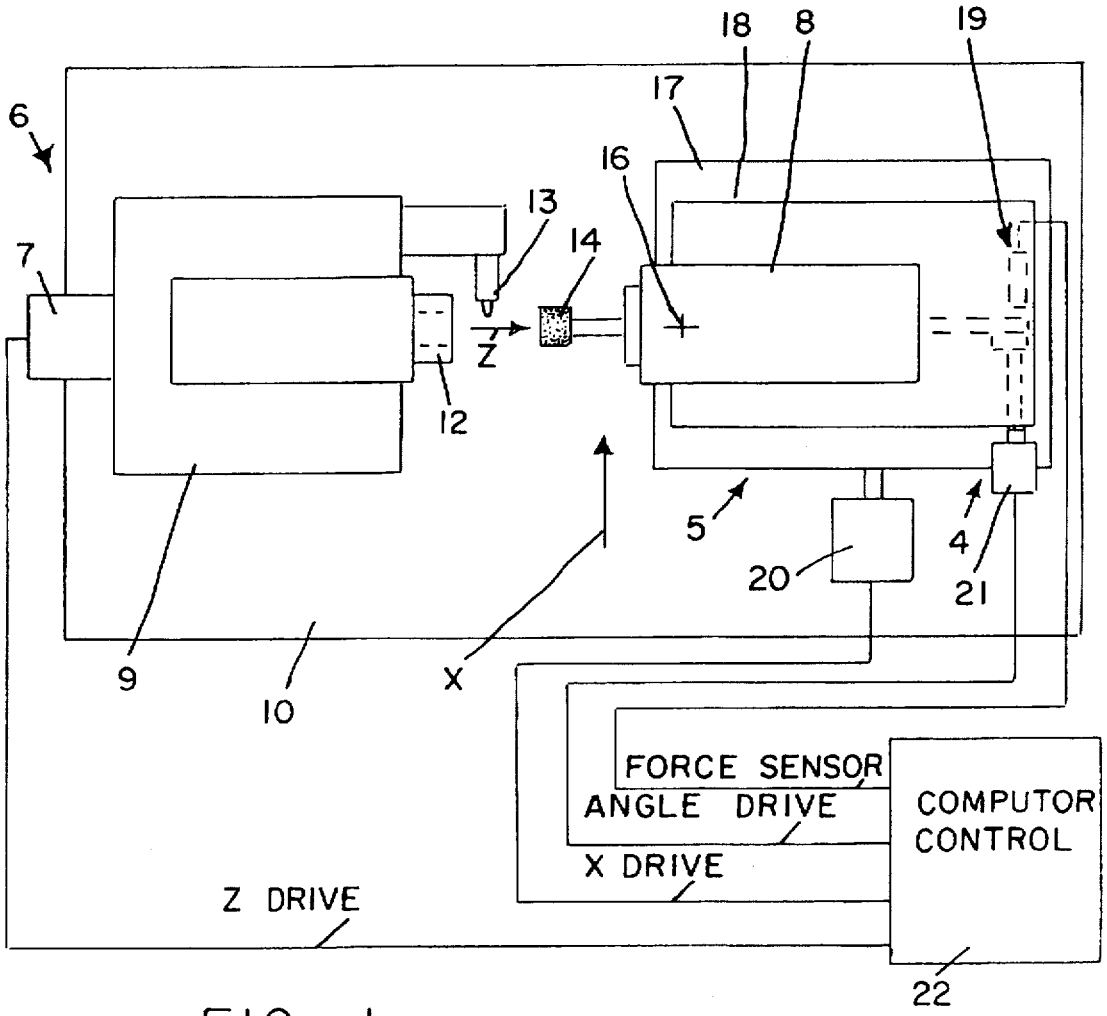
FIG. 1 is a plan view showing the basic components of a typical internal chucking-type grinding machine.

Referring first to FIG. 1, wherein is shown the general features of the invention. A typical internal chucking-type grinding machine is shown consisting of a base 10, a longitudinal feed mechanism, generally indicated by the reference numeral 6 and a transverse feed mechanism, generally indicated by the reference numeral 5. The longitudinal feed mechanism 6 includes a longitudinal feed slide or support 9 slidably mounted on the base 10 for movement along a longitudinal axis indicated by arrow Z, and carrying a workhead 11 with a chuck for supporting a workpiece 12, to be internally ground. The longitudinal axis Z is also the axis of revolution of the workpiece 12. The longitudinal feed slide 9 also supports a conventional dressing apparatus 13. The slide 9 is moved along the Z axis by first feed means 7. The transverse feed mechanism 5 at the opposite end of the base 10 includes a transverse feed slide 17 and second feed means 20 for moving the transverse feed slide 17 along a transverse axis indicated by arrow X. Mounted on the transverse feed slide 17 is an elastically-supported wheelhead supporting structure 18 containing a displacement sensor 19. The wheelhead supporting structure 18 also supports a wheelhead 8 which has a grinding wheel 14 mounted on the end of a rotatable spindle 15. The spindle 15 extends toward the workpiece 12 along the axis of revolution Z of the workpiece 12. The structure 18 is pivoted about a vertical pivoting axis at point 16 by a drive means, generally indicated by the reference numeral 4. Drive means 4 includes a stepper motor 21 mounted on the transverse feed slide 17. The stepper motor 21 produces small angular displacements of the wheelhead support structure 18 for compensating for the angular deflection of the grinding wheel 14 and spindle 15.

Figure 2:
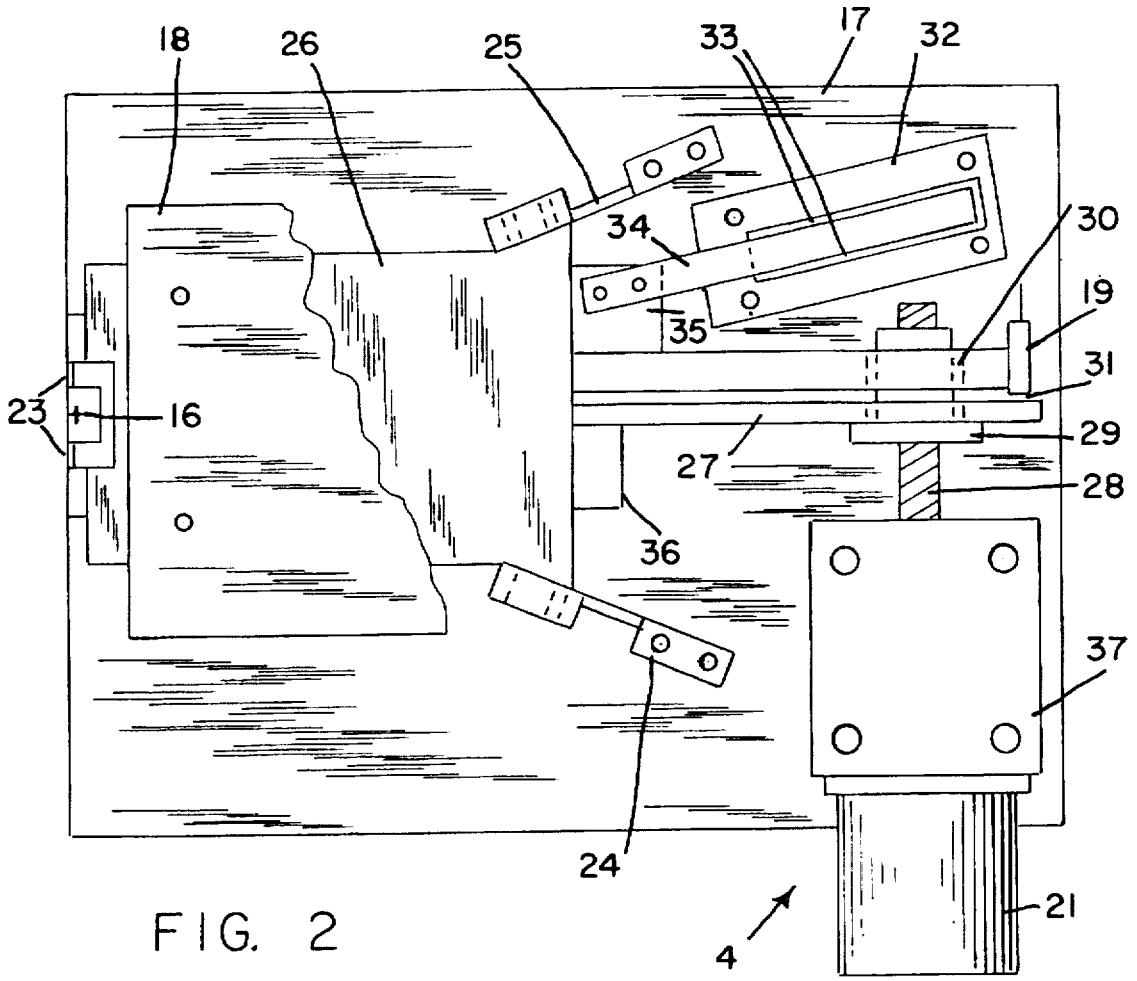
FIG. 2 is a plan view of the frictionless force-sensing, micro-angling wheelhead supporting structure.
Figure 3:
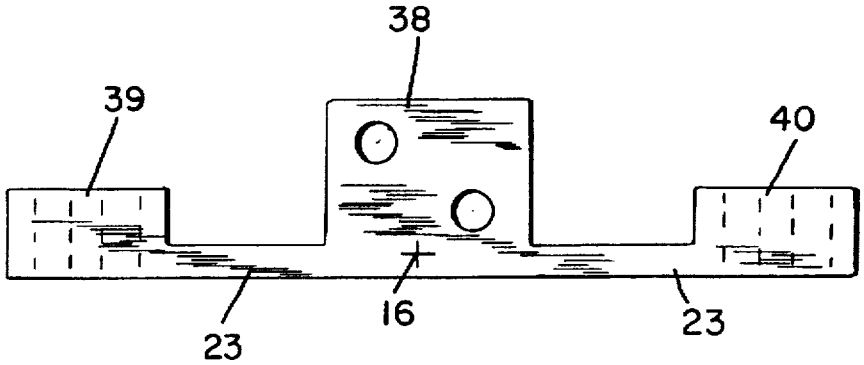
FIG. 3 is a plan view of the flexural pivot support for the wheelhead at the front end of the wheelhead supporting structure.
Figure 4:
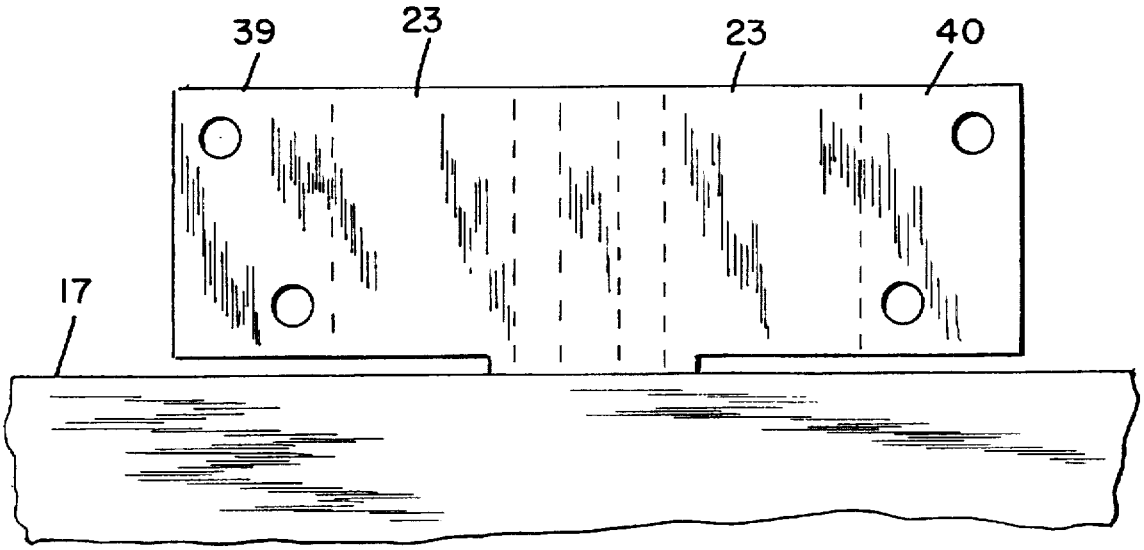
FIG. 4 is a front elevational view of the flexural pivot support of FIG. 3.
Figure 5:
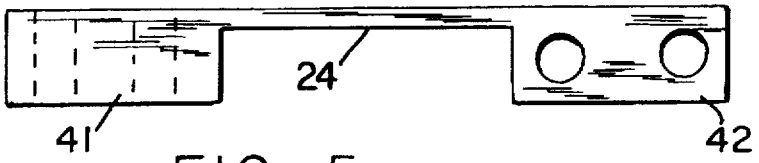
FIG. 5 is a plan view of one of the flexural supports at the rear end of the wheelhead supporting structure.
Figure 6:
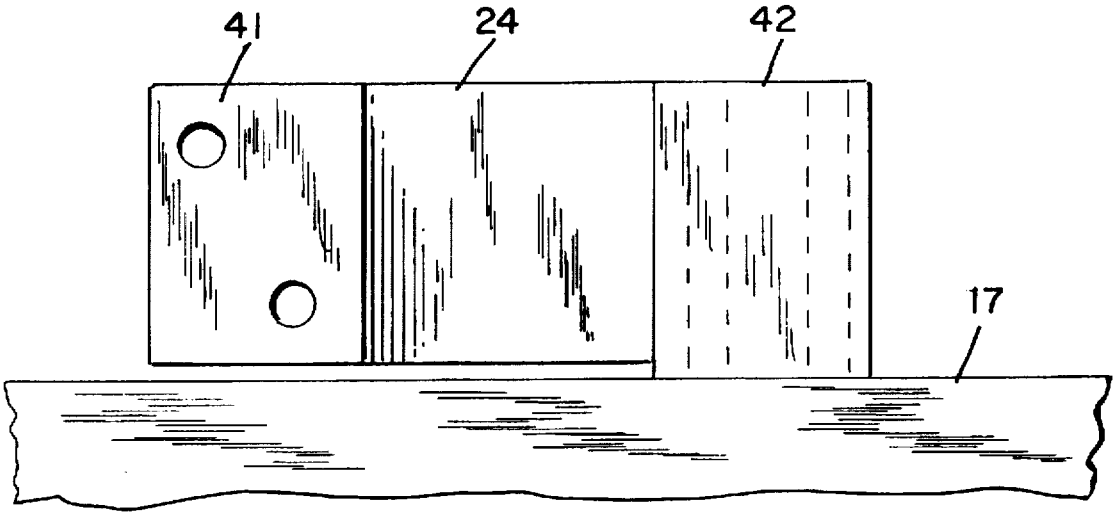
FIG. 6 is a side elevational view of the flexural support of FIG. 5.

The commercially available wheelhead 8 is fastened to plate 18. Details of the frictionless, force-sensing, micro-angling, wheelhead-supporting plate 18 are more clearly shown in FIG. 2. The wheelhead support structure 18 consists of a plate which is bolted to a member 26 which, in turn, is supported by a flexural pivot 23 and flexural elements 24 and 25, shown in detail in FIGS. 3–6. The flexural pivot 23, FIGS. 3 and 4, consists of a mounting block 38, which is bolted securely to the transverse feed slide 17, and two elastically-deformable wings 39 and 40, which are securely bolted to the support member 26. A small clearance is maintained between the support member 26 and the top surface of the transverse feed slide 17. The elastically-deformable wings 39 and 40 provide an effective pivoting axis at point 16. The flexural elements 24 and 25, shown in FIGS. 5 and 6, consist of block 42 which is securely bolted down to the transverse feed slide 17 and block 41 which is securely bolted to support member 26, again maintaining a small clearance between the support member 26 and the top surface of the transverse feed slide 17, thereby providing a frictionless support for the wheelhead.

The grinding force which is applied to the wheel 14 causes a moment and a tendency for rotation of the wheelhead supporting structure 18 and the rod 27 about the pivoting axis at point 16. A first end of a stiffening element 27 is fastened securely to member 26 through block 36. A second end of the stiffening element 27 is substantially restrained by ball nut 29 and ball screw 28. The stiffening element 27, in resisting the moment produced by the grinding force, undergoes very minute deflection which is proportional to the deflection of the spindle 15 as a result of a normal grinding force. That deflection is detected by the displacement sensor 19 which measures changes in the air gap 31. The sensor 19 is carried on the stress-free member 30 which is fastened securely through block 35 to support member 26. An analog electrical signal from the sensor 19 is fed to a signal conditioning network, an analog-to-digital converter and the computer control. After calibration, that signal is converted to normal grinding force and is used to calculate the deflection of the system. The deflection of the grinding system is equal to the normal force divided by the grinding system stiffness. The grinding system stiffness is derived from a series of compliances consisting of elements in the feed train, such as ball screws, thrust bearings, wheelhead spindles, wheel-supporting quills, the workpiece and its supporting structure and the grinding wheel itself.

In order to compensate for the angular deflection of the wheel 14 and quill 15, the support member 26 and support plate 18 are displaced angularly about the pivoting axis at point 16 by the stepper motor 21, turning the ball screw 28 to displace the ball nut 29 and the stiffening element or indicator rod 27. That microangular displacement is calculated by the computer to equal the angular deflection of the wheel when subjected to the normal grinding force. The computer outputs electrical pulses to the stepper motor to generate the angular deflection. As a result, taper errors in the internal ground surface of the workpiece are eliminated and no sparkout period is required, thereby saving cycle time. On prior art machines, it is necessary to provide a sparkout period to correct the taper. When a dressing operation of the wheel is performed, the stepper motor 21 returns support member 26 and support plate 18 to the undeflected position, thereby dressing a straight wheel.

Figure 7:
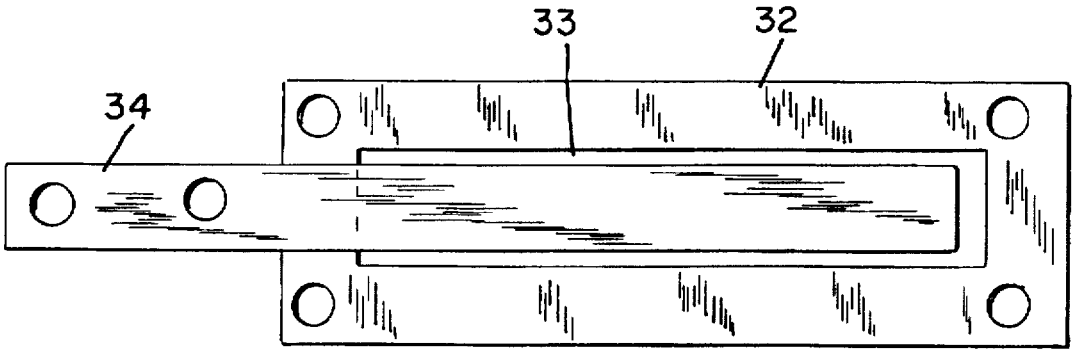
FIG. 7 is a top plan view of a vibration damper for the wheelhead supporting structure.
Figure 8:
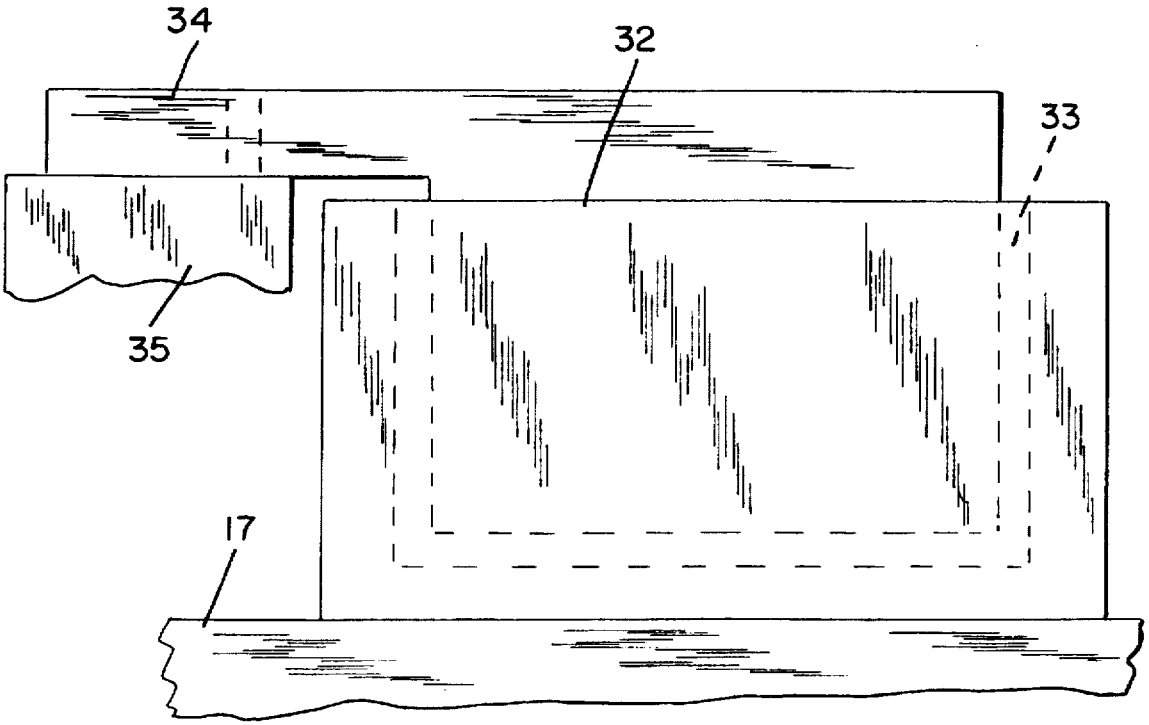
FIG. 8 is a side elevational view of the wheelhead damper of FIG. 7.

Since the above wheelhead supporting system is frictionless, which is required for accurate measurement of the grinding force, it constitutes a dynamic system capable of producing unwanted vibrations. The vibration control elements 32, 33, 34 are provided to dampen the system and to eliminate "ringing". FIGS. 7 and 8 are top and side views, respectively, of the passive damping oil reservoir 32, showing the immersed plate 34 in the oil reservoir. That reservoir is filled with a charge of viscous oil and does not require an oil supply system. The thick oil film 33 on both sides of the plate 34 provides "squeeze film" dampening, and at the same time, provides enough clearance for the microangularing of the wheelhead supporting structure 18. The immersed plate 34 is securely attached to block 35 and element 26. The reservoir 32 is securely attached to the transverse slide 17, permitting limited relative motion between support member 26 and the transverse slide.

Figure 9:
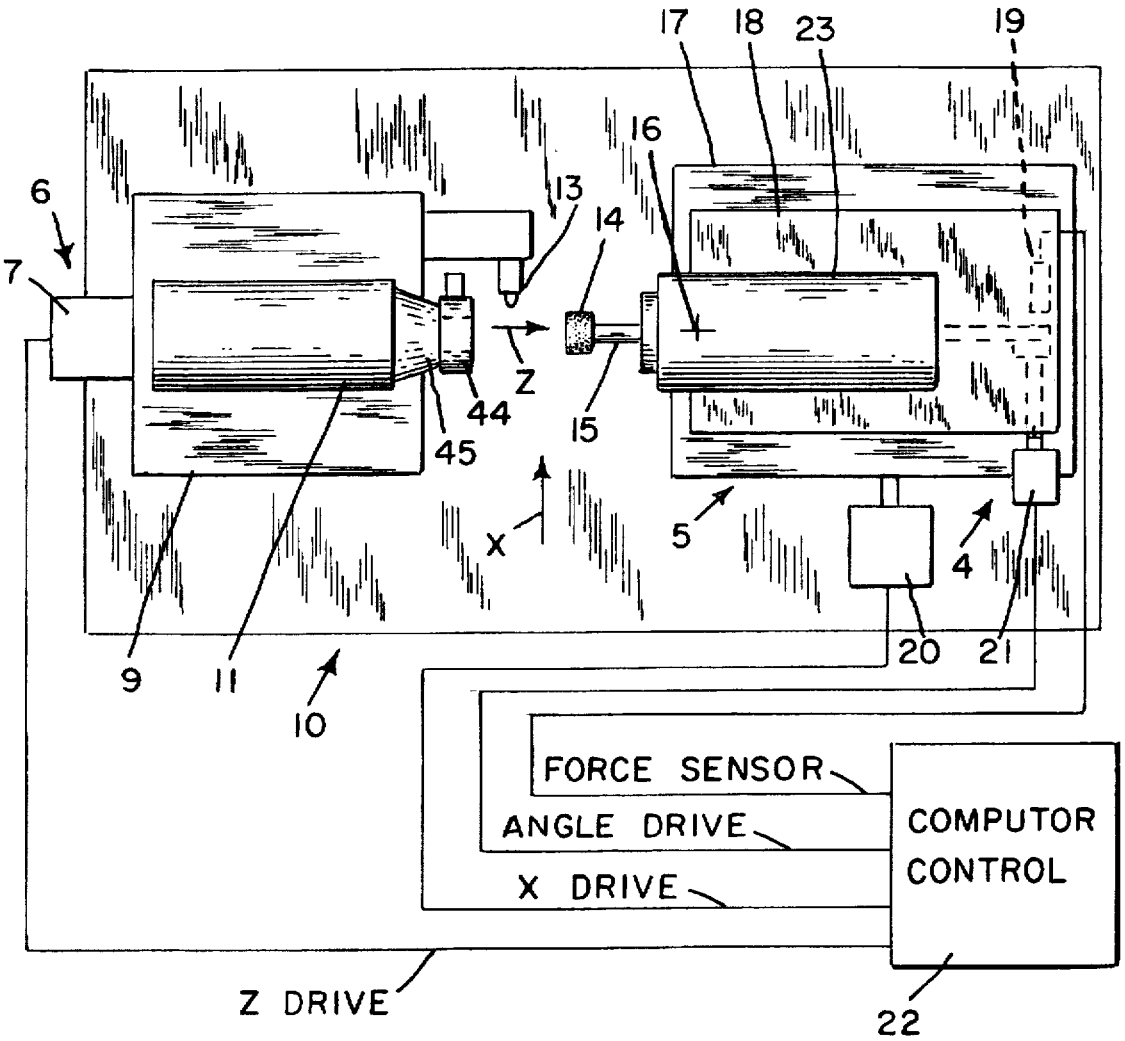
FIG. 9 is a plan view showing the basic components of a typical shoe-type internal grinding machine.
Figure 10:
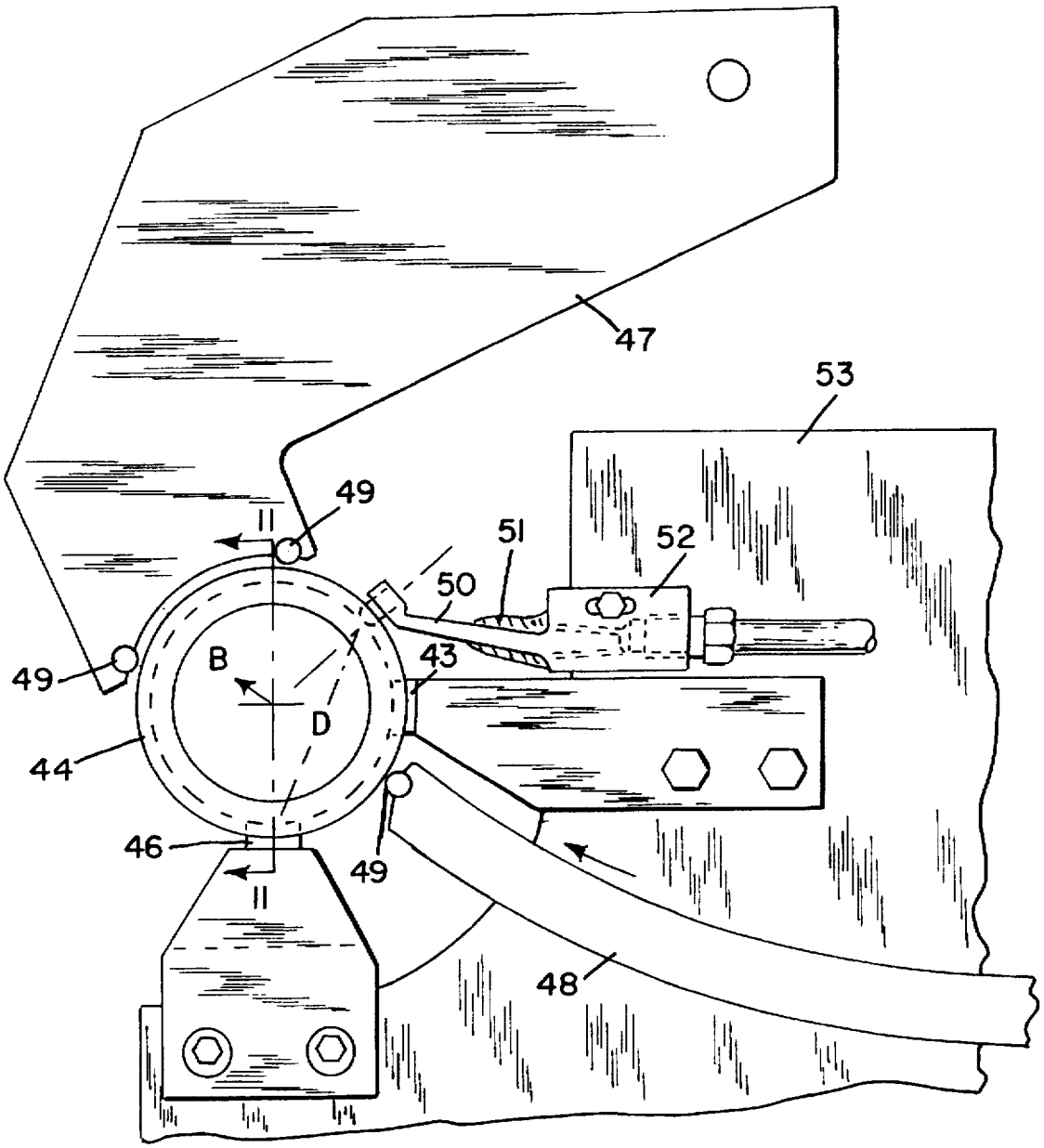
FIG. 10 is an end view of the grinding machine of FIG. 9, showing a thin-walled ring-shaped workpiece supported and located by the 3 o'clock and 6 o'clock shoes, and showing the location of the OD size-variation sensor.
Figure 11:
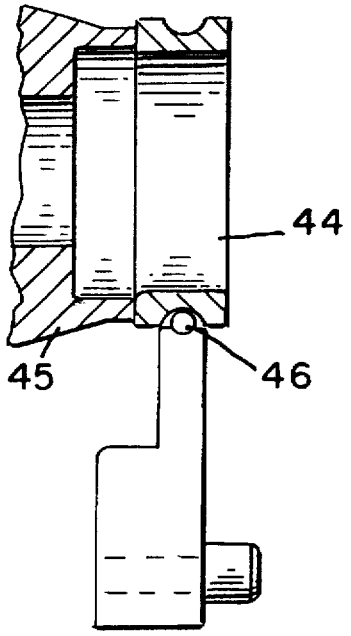
FIG. 11 is a vertical cross-sectional view of the ring-shaped workpiece taken along the line II—II of FIG. 10.

In addition to compensating for lateral and angular deflection errors that occur in prior art machines, this invention also eliminates size errors caused by variations in diameter of the outside diameter of thin-walled bearing rings mounted in shoe-type internal grinding machines. FIG. 9 is a plan view of the grinding machine of FIG. 1 modified as a typical shoe-type machine showing a magnetic face plate 45 mounted on the workhead 11, and driving a ring-like workpiece, such as a ball bearing inner ring 44 against a pair of stationary carbide shoes 43 and 46. The ring 44 is rotated about a workhead axis of revolution Z by the workhead 11. A more detailed side view is shown in FIG. 10. The ball bearing inner ring 44 is located by the carbide shoes 43 and 46, and is rotated thereon, by the rotating magnetic face plate 45 as shown in FIG. 11. The workpieces are automatically loaded and unloaded by the work locator 47 and the ejector 48 which execute arcuate motions to eject the ground workpiece along a workpiece ejection trajecting into an escapement trough and acquire the next workpiece to be ground. The workpiece, once loaded into the shoes 43 and 46, clears the three locator pins 49. If a workpiece having a slightly larger outside diameter than the norm is loaded, its center is displaced in the direction B. When the bore of the workpiece is ground, a size error results on prior art machines. The invention eliminates that source of error by capturing the chordal distance D with the OD size sensor 50. The sensor consists of a cantilever beam with electrical resistive strain gauges 51 bonded at its root, and a wear-resistant tip engaging the workpiece at its free end. The strain gauges are suitably protected by water-resistant covering. The lead wires are fed through holes in the mounting block 52 which is securely fastened to the shoe mounting bracket 53. The strain gauges are powered from a suitable power source and the generated signal fed back to the computer via an analog-to-digital channel. Once calibrated, the computer acquires the OD size variation from the norm, and modulates the final size position of the transverse slide 17 as the ID grinding operation is performed to compensate for said OD variations. The workhead 11 is moved along the workhead axis of revolution Z toward the grinding wheel 14 by the longitudinal feed mechanism 6. The grinding wheel 14 is moved along the transverse axis toward the inner cylindrical surface of the ring 44 by the transverse feed mechanism 5.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A grinding machine for grinding an internal surface of revolution about an axis of revolution on a workpiece, said grinding machine comprising:

(a) a base;

(b) a workhead for supporting the workpiece and for rotating the workpiece about said axis of revolution;

(c) a wheelhead having a front end which faces said workhead, a rear end and a rotatable spindle which supports an abrasive wheel, said spindle extending toward the workpiece from the front end of said wheelhead along said axis of revolution, said spindle being deflectable from said axis of revolution;

(d) a longitudinal feed mechanism for supporting said workhead and for moving said workhead relative to said base along said axis of revolution toward and away from said wheelhead to enable said abrasive wheel to abut the surface of revolution of said workpiece;

(e) a wheelhead supporting structure for supporting said wheelhead so that said wheelhead is pivotable relative to said base about a pivoting axis adjacent the front end of said wheelhead, said pivoting axis being transverse to said axis of revolution;

(f) an elongated stiffening element having a first end rigidly connected to the rear end of said wheelhead and a second end operatively connected to said wheelhead supporting structure, said stiffening element restraining angular displacement of said wheelhead supporting structure about said pivoting axis caused by the normal grinding force between the abrasive wheel and the workpiece, the second end of said stiffening element being deflectable relative to the first end of said stiffening element as a result of said normal grinding force, the deflection of said stiffening element being proportional to said the deflection of said spindle;

(g) a transverse feed mechanism for supporting said wheelhead supporting structure and for moving said wheelhead transversely of said axis of revolution to cause said abrasive wheel to engage said surface of revolution for grinding said surface of revolution, so that the engagement of said abrasive wheel against said surface of revolution with a normal grinding force causes said spindle to deflect from said axis of revolution, and causes said wheelhead supporting structure to pivot about said pivoting axis and the second end of said stiffening element to deflect relative to the first end of said stiffening element, the deflection of said stiffening element being proportional to said the deflection of said spindle;

(h) sensing means for measuring said deflection of said stiffening element and for producing an analog electrical signal which is proportionally indicative of said deflection of said stiffening element, said sensing means including a converter for converting said analog electrical signal to a digital electric signal; and (i) drive means, including a digital computer, operatively connected to said stiffening element and to said sensing means for receiving said digital electrical signal and for angularly positioning said wheelhead supporting structure about said pivoting axis in response to said digital electrical signal.

2. A grinding machine as recited in claim 1, wherein said wheelhead-supporting structure comprises:

(a) a forward flexural pivot support element having a central portion fixed to said transverse slide, and second and third portions flexibly connected to said central portion, each of said second and third portions being fixed to the front end of said wheelhead-supporting structure to support said structure with no frictional rubbing contact with said transverse slide; and (b) at least two rearward flexural support elements having one end which is fixed to said transverse slide and another end fixed to said wheelhead-supporting structure, each of said rearward flexural support having a bending axis which intersects said forward flexural pivot support at said pivoting axis to provide frictionless support for said wheelhead.

3. A grinding machine as recited in claim 1, wherein said grinding machine further comprises a damping means fixed to said transverse feed mechanism and said wheelhead/supporting structure to prevent vibration of said wheelhead-supporting structure.

4. A grinding machine as recited in claim 3, wherein said damping means comprises:

(a) a housing fixed to said transverse slide which has a chamber filled with a damping liquid;

(b) a plate which is freely immersed in the damping liquid within said chamber; and (c) a connecting arm which is fixed to said plate and to said wheelhead/supporting structure.

5. A grinding machine as recited in claim 1, wherein said drive means is a stepper motor operatively connected to the second end of said stiffening element, coupled to a ball screw mounted in a pair of preloaded ball bearings to position said ball nut.

6. A grinding machine as recited in claim 5, wherein said drive means comprises:

(a) a nut fixed to the second end of said stiffening element;

(b) a screw threaded into said nut and mounted in said stepper motor for rotation about its central longitudinal axis.

7. A grinding machine for grinding an internal surface of revolution about an axis of revolution on a workpiece, said grinding machine comprising:

(a) a base;

(b) a workhead for supporting the workpiece and for rotating the workpiece about said axis of revolution;

(c) a longitudinal feed slide for supporting said workhead, said longitudinal feed slide being slidably mounted of the base for movement along said axis of revolution;

(d) a wheelhead having a front end which faces said workhead, a rear end and a rotatable spindle which supports an abrasive wheel, said spindle extending toward the workpiece from the front end of said wheelhead along said axis of revolution, said spindle being deflectable from said axis of revolution;

(e) a transverse feed slide mounted on said base for movement transversely of said axis of revolution;

(f) a wheelhead supporting structure mounted on said transverse feed slide for supporting said wheelhead on said transverse feed slide so that said wheelhead is pivotable relative to said transverse slide about a pivoting axis adjacent the front end of said wheelhead, said pivoting axis being transverse to said axis of revolution;

(g) an elongated stiffening element having a first end rigidly connected to the rear end of said wheelhead and a second end operatively connected to said transverse feed slide, said stiffening element restraining angular displacement of said wheelhead supporting structure about said pivoting axis caused by the normal grinding force between the abrasive wheel and the workpiece, the second end of said stiffening element being deflectable relative to the first end of said stiffening element as a result of said normal grinding force;

(h) first feed means for moving said longitudinal feed slide and said workhead along said axis of revolution toward and away from said wheelhead to enable said abrasive wheel to abut the surface of revolution of said workpiece;

(i) second feed means for moving said transverse support and said wheelhead transversely of said horizontal axis to cause said abrasive wheel to engage said surface of revolution for grinding said surface of revolution, so that the engagement of said abrasive wheel against said surface of revolution with a normal grinding force causes said spindle to deflect from said axis of revolution, said wheelhead supporting structure to pivot about said pivoting axis and the second end of said stiffening element to deflect relative to the first end of said stiffening element, the deflection of said stiffening element being proportional to said the deflection of said spindle;

(j) sensing means for measuring said deflection of said stiffening element and for producing an analog electrical signal which is proportionally indicative of said deflection of said stiffening element, said sensing means including a converter for converting said analog electrical signal to a digital electric signal; and (k) drive means, including a digital computer, operatively connected to said stiffening element and to said sensing means for receiving said digital electrical signal and for angularly positioning said wheelhead supporting structure about said pivoting axis in response to said digital electrical signal.

8. A grinding machine for grinding the inner cylindrical surface of a ring-shaped workpiece which has an outer cylindrical surface, said grinding machine comprising:

(a) a base;

(b) a workhead having a magnetic face plate for magnetically attracting the ring-shaped workpiece, said workhead having a workhead axis of revolution;

(c) a pair of fixed angularly spaced shoes arranged in a plane parallel to and axially offset from said magnetic face plate to engage and locate the outer cylindrical surface of said ring-shaped workpiece for establishing a workpiece axis of revolution which is offset from said workhead axis of revolution so as to produce a magnetically derived thrust force driving said workpiece into said fixed angularly spaced shoes in addition to rotating said workpiece about said workpiece axis of revolution;

(d) a transverse slide support slidably mounted on said base for movement transverse of the workhead axis of revolution;

(e) a wheelhead mounted on said transverse slide support and having a rotatable spindle which carries an abrasive wheel, said spindle having an axis of revolution;

(f) a longitudinal feed mechanism for moving said workhead along said workhead axis of revolution toward and away from said wheelhead to bring said abrasive wheel into abutment with the inner cylindrical surface of the workpiece;

(g) a transverse feed mechanism for moving said transverse slide support and said wheelhead to cause said abrasive wheel to radially engage the inner cylindrical surface of the workpiece for grinding said inner cylindrical surface;

(h) sensing means including a sensor mounted on said grinding machine for detecting the position of the outer cylindrical surface of the workpiece, at a point tangent to said workpiece-ejection trajectory, of an arbitrary workpiece relative to the outer cylindrical position of a workpiece representing the norm of a series of workpieces, said sensing means generating an analog electrical signal which is indicative of the relative size difference of the outer cylindrical surface of said workpiece, said sensing means including a converter for converting said analog signal to a digital electrical signal; and (i) a digital computer operatively connected to said sensing means and said transverse feed means, for calculating the relative size difference of said arbitrary workpiece based on the digital electrical signal from said sensing means and for controlling said transverse feed means to position said grinding wheel relative to said fixed angularly spaced shoes to eliminate errors in size of the inner cylindrical surface of said workpiece resulting from variations in size of the outer cylindrical surface of said workpiece.

9. A grinding machine as recited in claim 8, wherein the sensor of said sensing means is a displacement sensor.

* * * * *